US009192217B1

(12) United States Patent
Vargas

(10) Patent No.: US 9,192,217 B1
(45) Date of Patent: Nov. 24, 2015

(54) ACCORDION WALLET WITH ELECTROMAGNETIC SHIELDING

(71) Applicant: Alastair Vargas, Alameda, CA (US)

(72) Inventor: Alastair Vargas, Alameda, CA (US)

( * ) Notice: Subject to any disclaimer, the term of this patent is extended or adjusted under 35 U.S.C. 154(b) by 9 days.

(21) Appl. No.: 14/077,568

(22) Filed: Nov. 12, 2013

(51) Int. Cl.
*A45C 1/06* (2006.01)
*A45C 13/02* (2006.01)

(52) U.S. Cl.
CPC .. *A45C 13/02* (2013.01); *A45C 1/06* (2013.01)

(58) Field of Classification Search
CPC ..... A45C 1/06; A45C 13/34; A45C 13/005; A45C 2001/065; A45C 2001/067; A45C 11/182
USPC ..... 150/147, 145, 149; 206/311, 425; 402/777; 281/37, 49
See application file for complete search history.

(56) References Cited

U.S. PATENT DOCUMENTS

| | | | | | |
|---|---|---|---|---|---|
| 1,896,573 | A * | 2/1933 | Buxton | 40/661.06 |
| 2,432,557 | A * | 12/1947 | Broughton | 150/149 |
| 3,029,854 | A * | 4/1962 | Burniski | 150/149 |
| 3,324,918 | A * | 6/1967 | Miller | 150/149 |
| 3,648,832 | A * | 3/1972 | Kirshenbaum et al. | 206/37 |
| 4,793,508 | A * | 12/1988 | Thompson | 220/533 |
| 5,725,098 | A * | 3/1998 | Seifert et al. | 206/472 |
| 5,941,375 | A * | 8/1999 | Kamens et al. | 206/38 |
| 6,121,544 | A * | 9/2000 | Petsinger | 174/353 |
| 6,409,013 | B1 * | 6/2002 | Eskandry | 206/308.1 |
| 6,871,682 | B2 * | 3/2005 | Hogganvik | 150/149 |
| 7,830,672 | B1 * | 11/2010 | Kitchen | 361/818 |
| 2013/0025750 | A1 * | 1/2013 | Wingerter et al. | 150/149 |

* cited by examiner

*Primary Examiner* — Sue A Weaver

(57) ABSTRACT

An accordion wallet with electromagnetic shielding includes an outer case comprised of a first member and a second member that are connected via a hinge member. The first member and the second member include webbing members on opposing sides, which opens to limit exposure to the interior of the wallet. The interior of the wallet includes a plurality of copper sleeves that are configured to each store a single credit card. The copper sleeves prevent electromagnetic radiation from interacting with the magnetic strips of the credit cards.

4 Claims, 4 Drawing Sheets

ACCORDION WALLET WITH ELECTROMAGNETIC SHIELDING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wallets, more specifically, a wallet that includes an electromagnetic shielding, and which also includes an accordion framework.

SUMMARY OF THE INVENTION

An embodiment of the disclosure meets the needs presented above by generally comprising a wallet with an outer case comprised of a first member and a second member that are connected via a hinge member. The first member and the second member include webbing members on opposing sides, which opens to limit exposure to the interior of the wallet. The interior of the wallet includes a plurality of copper sleeves that are configured to individually store a single credit card therein. The copper sleeves prevent electromagnetic radiation from interacting with the magnetic strips of the credit cards.

An object of the invention is to provide a wallet particularly suited for protecting magnetic strips of credit cards.

These together with additional objects, features and advantages of the accordion wallet with electromagnetic shielding will be readily apparent to those of ordinary skill in the art upon reading the following detailed description of presently preferred, but nonetheless illustrative, embodiments of the accordion wallet with electromagnetic shielding when taken in conjunction with the accompanying drawings.

In this respect, before explaining the current embodiments of the accordion wallet with electromagnetic shielding in detail, it is to be understood that the accordion wallet with electromagnetic shielding is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the accordion wallet with electromagnetic shielding.

It is therefore important that the claims be regarded as including such equivalent construction insofar as they do not depart from the spirit and scope of the accordion wallet with electromagnetic shielding. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
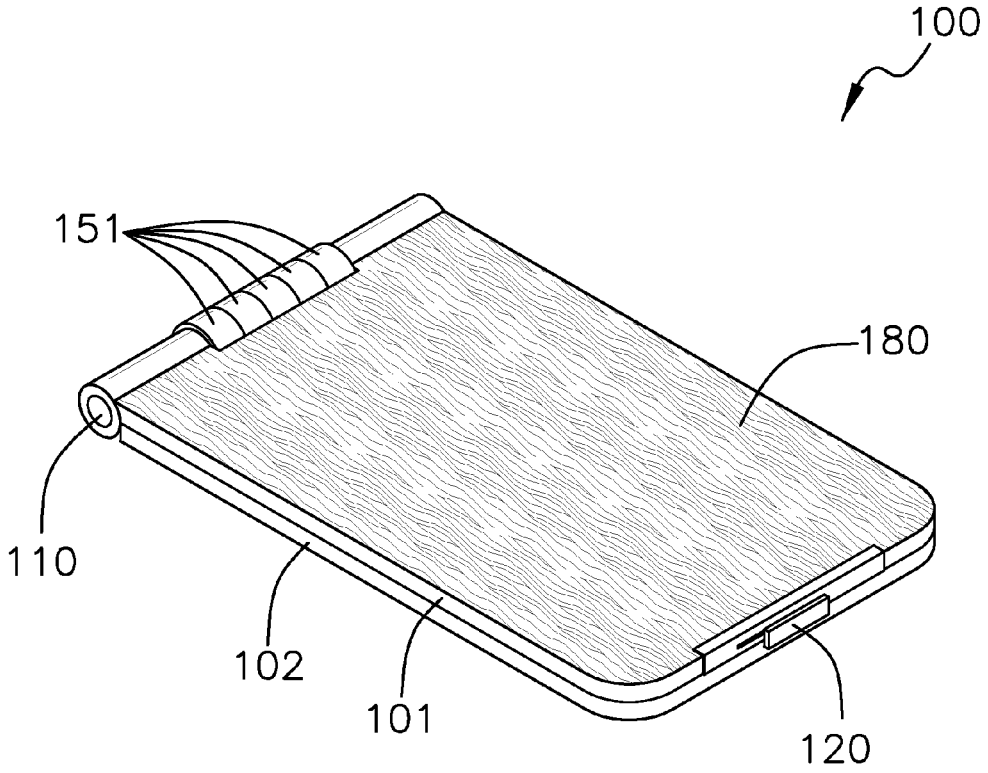
FIG. 1 is a top, perspective view of the accordion wallet with electromagnetic shielding in a closed orientation.
Figure 2:
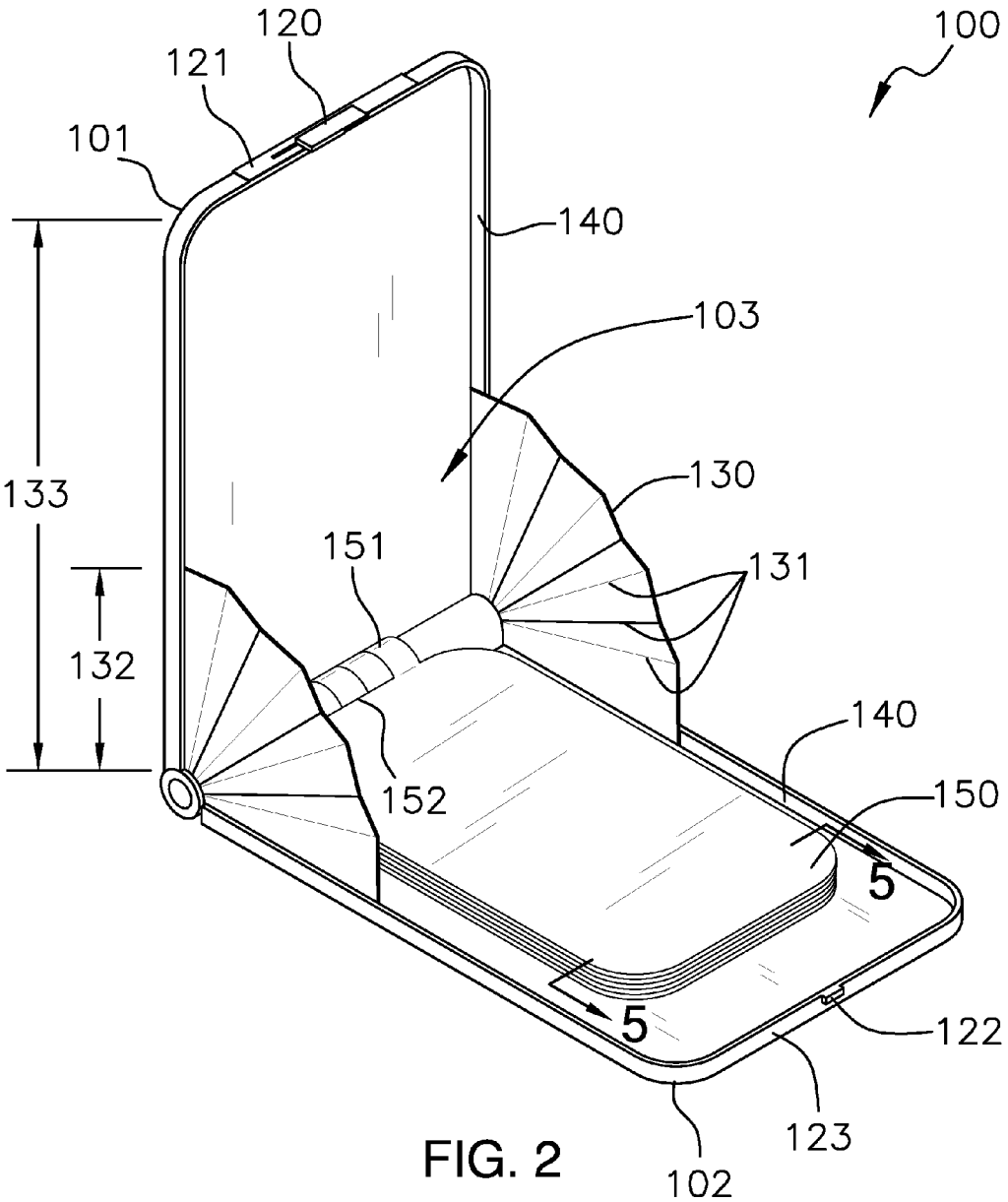
FIG. 2 is a top, perspective view of the accordion wallet with electromagnetic shielding in an opened orientation.
Figure 3:
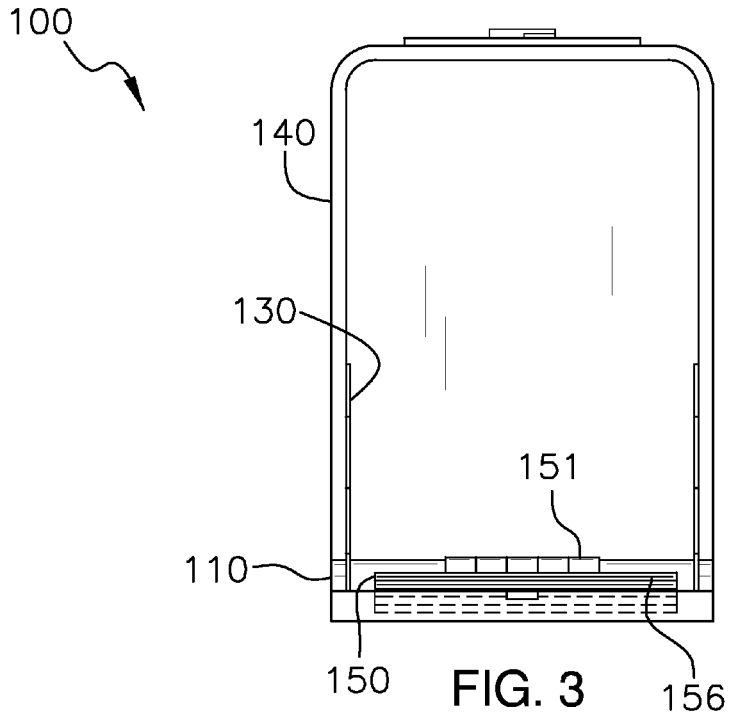
FIG. 3 is a front view of the accordion wallet with electromagnetic shielding.
Figure 4:
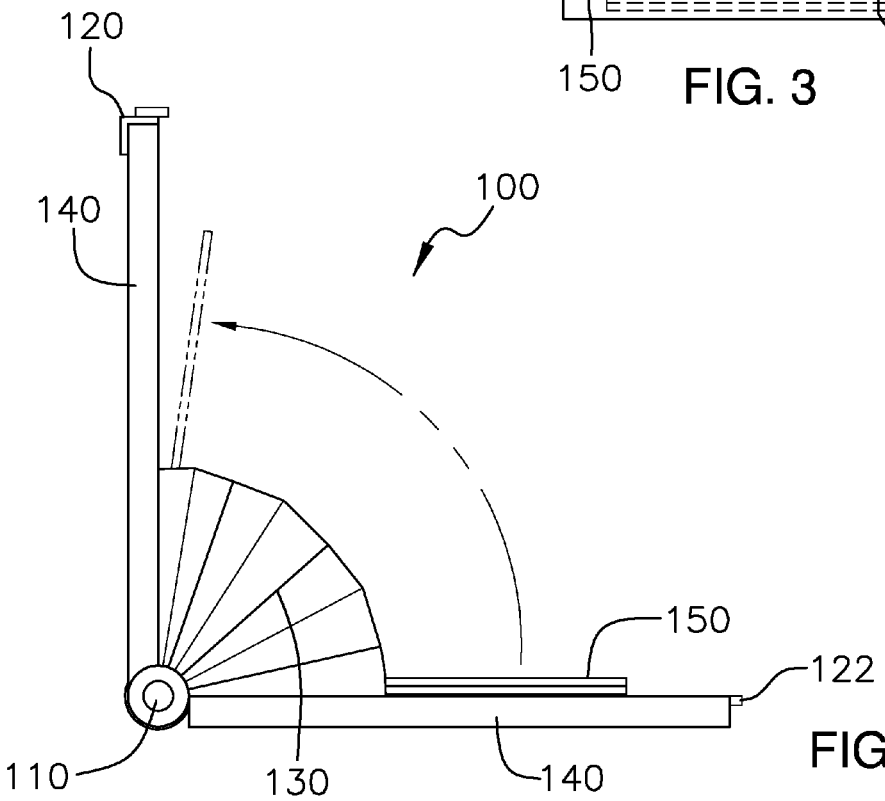
FIG. 4 is a side view of the accordion wallet with electromagnetic shielding.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the accordion wallet with electromagnetic shielding 100 (hereinafter invention) is further comprised of a first member 101 and a second member 102 that collectively form an outer case that encloses an interior compartment 103 formed therein. The first member 101 and the second member 102 connect together via a hinge member 110 such that the first member 101 rotates towards and from the second member 102. It shall be noted that the hinge member 110 may be made of a plastic, metal, wood, carbon fiber composite.

The first member 101 includes a slide latch 120 on a first distal edge 121 of the first member 101. The slide latch 120 engages a clip member 122 located on a second distal edge 123 of the second member 102. Both the first member 101 and the second member 102 include webbing members 130 on opposing sides of the first member 101 and the second member 102. The webbing member 130 is an expandable object that includes multiple folds 131 that enable the webbing member 130 to fold compactly or to unfold. The webbing member 130 is further defined with a webbing length 132 that is less than a side length 133 of either the first member 101 or the second member 102.

The first member 101 and the second member 102 are each further defined with a lip protuberance 140 that extends along three of the four sides, and with the exception of the side adjacent the hinge member 110. The lip protuberance 140 includes the first distal edge 121 and the second distal edge 123. The webbing members 130 are attached to the first member 101 and the second member 102 within the lip protuberance 140. The first member 101 and the second member 102 may include leather exteriors 180 that cover an outer surface of the respective members. The first member 101 and the second member 102 may be made of a flexible material so as to adjust and contour to the conditions presented thereto.

For example, if the invention 100 is placed in a closed state into a back pocket of a pair of pants, and an end user sits thereon, the first member 101 and the second member 102 are able to contour to the weight presented thereto.

The invention 100 also includes a plurality of copper sleeves 150 that are hingedly affixed to the hinge member 110 and reside within the first member 101 and the second member 102. The copper sleeves 150 each include a hinge armature 151 that is located on an inner sleeve edge 152, and which connects to the hinge member 110 such that the copper sleeves 150 individual rotate with respect to the hinge member 110.

Figure 5:
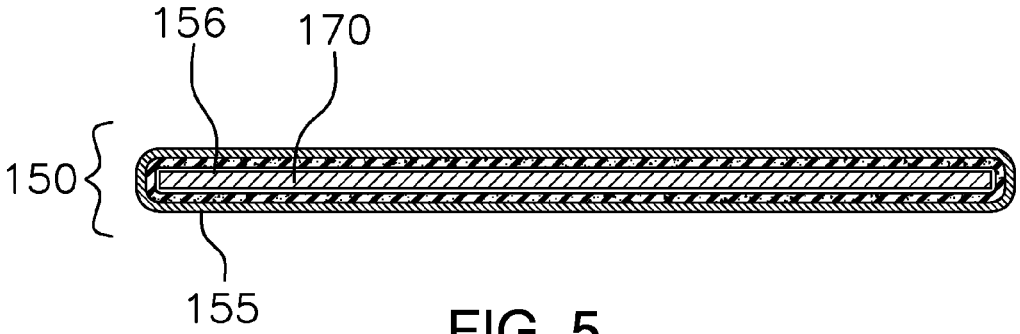
FIG. 5 is a cross-sectional view of the accordion wallet with electromagnetic shielding along line 5-5 in FIG. 2.

Referring to FIG. 5, the copper sleeves 150 are each further defined with a waterproof membrane 155 that encircles the copper sleeve 150. The copper sleeve 150 includes a credit card slot 156 that is configured to enable a credit card 170 to be inserted and removed from the copper sleeve 150. It shall be noted that the copper sleeve 150 is configured to store the credit card 170 therein, and to protect the magnetic strip located on the credit card 170 from damage associated with an electromagnetic pulse.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accordion wallet with electromagnetic shielding comprising:

a first member and a second member connected to one another via a hinge member;

webbing members provided on opposing sides of the first member and the second member;

a plurality of copper sleeves are each connected to the hinge member and situated between the first member and the second member; and wherein the copper sleeves are each configured to store a credit card therein so as to protect the credit card magnetic strip from electromagnetic fallout;

wherein the first member and the second member collectively form an outer case that encloses an interior compartment formed therein;

wherein the first member and the second member connect together via the hinge member such that the first member rotates towards and from the second member;

wherein the first member includes a slide latch on a first distal edge of the first member; wherein the slide latch engages a clip member located on a second distal edge of the second member;

wherein the webbing member is an expandable object that includes multiple folds that enable the webbing member to fold compactly or to unfold; wherein the webbing member is further defined with a webbing length that is less than a side length of either the first member or the second member.

2. The accordion wallet with electromagnetic shielding according to claim 1 wherein the first member and the second member are each further defined with a lip protuberance that extends along three of a total of four sides, and with the exception of the side adjacent the hinge member; wherein the lip protuberance includes the first distal edge and the second distal edge; wherein the webbing members are attached to the first member and the second member within the lip protuberance.

3. The accordion wallet with electromagnetic shielding according to claim 2 wherein the plurality of copper sleeves are hingedly affixed to the hinge member and reside within the first member and the second member; wherein the copper sleeves each include a hinge armature that is located on an inner sleeve edge, and which connects to the hinge member such that the copper sleeves individual rotate with respect to the hinge member.

4. The accordion wallet with electromagnetic shielding according to claim 3 wherein the copper sleeves are each further defined with a waterproof membrane that encircles the copper sleeve; wherein the copper sleeve includes a credit card slot that is configured to enable the credit card to be inserted and removed from the copper sleeve.

* * * * *